United States Patent [19]

Goltz

[11] Patent Number: 4,859,281

[45] Date of Patent: Aug. 22, 1989

[54] ETCHING OF COPPER AND COPPER BEARING ALLOYS

[75] Inventor: Kurt Goltz, West Whiteland, Pa.

[73] Assignee: Pennwalt Corporation, Philadelphia, Pa.

[21] Appl. No.: 58,066

[22] Filed: Jun. 4, 1987

[51] Int. Cl.[4] ..... C23F 1/00; C23F 1/18

[52] U.S. Cl. ..... 156/666; 156/664; 252/79.4

[58] Field of Search ..... 156/666, 664, 901; 252/79.2, 79.4

[56] References Cited

U.S. PATENT DOCUMENTS

| | | | |
|---|---|---|---|
| 3,269,881 | 3/1966 | Alderuccio et al. | 156/666 |
| 3,407,141 | 10/1968 | Banush | 252/79.4 |
| 3,537,895 | 11/1970 | Lancy | 134/3 |
| 3,597,290 | 8/1971 | Naito et al. | 156/666 |
| 3,649,194 | 3/1972 | Glanville | 134/3 |
| 3,668,131 | 6/1972 | Banush et al. | 156/666 X |
| 3,770,530 | 11/1973 | Fujimoto | 156/666 X |
| 3,773,577 | 11/1973 | Shibasaki et al. | 156/659.1 |
| 3,948,703 | 4/1976 | Kushibe | 156/666 |
| 4,051,057 | 9/1977 | Ericson et al. | 134/3 X |
| 4,086,176 | 4/1978 | Ericson et al. | 156/666 X |
| 4,233,133 | 11/1980 | Valayil et al. | 156/666 |
| 4,236,957 | 12/1980 | Valayil et al. | 156/666 |
| 4,384,979 | 5/1983 | Hansen | 252/389 A |
| 4,401,509 | 8/1983 | Schellinger | 156/666 |
| 4,437,928 | 3/1984 | Wong | 156/666 |
| 4,459,216 | 7/1984 | Nakazato et al. | 252/79.4 |
| 4,510,018 | 4/1985 | McGowan | 156/666 |
| 4,686,059 | 8/1987 | Payerle | 252/75 |

FOREIGN PATENT DOCUMENTS

| | | | |
|---|---|---|---|
| 57-134563 | 8/1982 | Japan | 252/79.4 |
| 60-190582 | 9/1985 | Japan | 156/666 |

*Primary Examiner*—David L. Lacey
*Assistant Examiner*—Andrew J. Anderson

[57] ABSTRACT

A copper etching composition and an improved method for copper etching utilizing the composition, the composition includes an aqueous solution of a strong acid, a stabilized hydrogen peroxide, and an accelerator that can include both tolyltriazole and either an aliphatic water soluble monoalcohol or a glycol monoether in the etchant solution to provide a faster etching rate.

27 Claims, No Drawings

ETCHING OF COPPER AND COPPER BEARING ALLOYS

BACKGROUND OF THE INVENTION

This invention relates to the method of dissolving or etching copper and copper bearing metals with hydrogen peroxide in an acidic solution with the emphasis on, but not limited to, the etching of printed circuit boards.

Heretofore, most copper etching has been done with either acidic cupric chloride solutions, ferric chloride solutions, alkaline ammonia etchants, or acid ammonium or sodium persulfate etchants. The largest quantities of these etchants are used by the electronic and related industries in the manufacture of printed circuit boards.

While each of the above etchant product types might not be useful for every possible requirement, generally, they have been accepted by the industry because of low cost, ease of operation, or speed of etching.

Because of much stricter environmental regulations enacted by federal, state, and local governments, waste effluents from chemical operations, such as metal etching, are no longer allowed in streams, rivers, or public sewage systems unless, essentially, all dissolved chemicals have been removed beforehand. This is a costly operation and not feasible for some operations. Recycling is also difficult, if not impossible, with the above named etching types.

Acid hydrogen peroxide etchants, the subject of this invention, are relatively easy to recycle. Most of these types of etchants are based on sulfuric acid and the excess of copper can be removed as copper sulfate crystals by simply chilling the solution. The copper can be reclaimed by electrolysis. Hydrogen peroxide itself is completely non-polluting and, in fact, is used in detoxification of sewage effluents and in the treatment of drinking water in some water works instead of chlorine.

Although some acid hydrogen peroxide etchings are commercially used, such use is still limited. There are several reasons for this. Historically, the hydrogen peroxide etching process was too expensive when compared to the more widely used ferric chloride or alkaline ammonia processes, as long as there were no strict requirements on the quality of the waste effluents. However, the main reason, at this time, is that the etching speed is too slow for the larger modern operations.

This invention overcomes this obstacle of slow etching speed. Pure hydrogen peroxide is an unstable chemical. When the peroxide comes in contact with metal surfaces or metal salt solutions are added to hydrogen peroxide (including copper), the peroxide decomposes rapidly. Such decomposition would make use of the peroxide impractical in an etching solution.

To overcome the peroxide instability problem, chemicals have been found that will stabilize hydrogen peroxide to an extent that it can be handled safely for many applications. However, these stabilized hydrogen peroxide formulas are now so inert that even the etching attack on metal is reduced to an impractical level. To accelerate the etching process, additives have to be found that will accelerate the etching without destabilizing the hydrogen peroxide, i.e., such additives ideally should be effective solely on the metal/liquid interface. Several such additives have been mentioned in the literature. Most of the additives which are based on organic compounds result in a moderate increase of etch rate, but fall short when compared with processes based on ferric chloride or cupric chloride. Additives based on mercury salts or salts of noble metals (such as silver, platinum, or palladium) are good accelerators but are either too expensive or too toxic. The above listed additives also destabilize the hydrogen peroxide to some extent, making the process less economical.

The accelerator used in the practice of the invention does not have any of the above named disadvantages while it provides a five fold or more increase in etch rate when compared to the same etching solution without an additive.

SUMMARY OF THE INVENTION

The improvement of the invention is defined as in a method for etching copper which includes treating the copper with an aqueous etchant solution, said solution including a mixture of an acid selected from the group consisting of sulfuric acid, nitric acid, sulfamic acid, and phosphoric acid; hydrogen peroxide; and water; the improvement which comprises incorporating an accelerating effective amount of both a triazole compound and either an aliphatic water soluble monoalcohol or a glycol monoether in the etchant solution to provide a faster etching rate.

The preferred triazole is tolyltriazole and it is preferably incorporated in the solution at a concentration of 1.5 gram/liter to 15 gram/liter of solution.

It is preferred that the hydrogen peroxide is stabilized with a compound selected from the group consisting essentially of a phenol, a phenol phosphoric acid, or a phosphonate. Of course, many other stabilized peroxides are available and similar improvements will be attained with such other peroxides.

The preferred sulfuric acid weight concentration is within the range of 5% to 25% of the solution and the hydrogen peroxide weight concentration is within the range of 5% to 25% of the solution.

Preferably, the solution includes hydrated copper sulfate at a concentration of 1% to 10% by weight which acts as a slight or mild accelerator for the initial start-up of the etching process ($CuSO_4$ is generated once etching begins).

Most preferably, a synergistic accelerating effective amount of a compound selected from the group consisting of an aliphatic water soluble monoalcohol and a glycol monoether is incorporated in the solution to greatly enhance the etching speed, while retaining HzOz stability. Preferably, the monoalcohol is selected from the group consisting of isopropanol, n-butyl alcohol, and t-butyl alcohol and the glycol monoether is selected from the group consisting of diethylene glycol monobutyl ether, and dipropylene glycol monoethyl ether and the triazole compound is mixed with the monoalcohol or the glycol monoether prior to incorporation in the solution.

The solution is preferably maintained at a temperature within the range of 25° C. to 50° C. and more preferably 35° C. to 45° C.

The invention also includes the use of tolyltriazole compound alone as the accelerator.

The composition of the invention includes all of the above-described etchant compositions used in practicing the method of the invention.

DESCRIPTION OF THE PREFERRED EMBODIMENTS

Tolyltriazole as the sole accelerator results in about a five-fold increase in etch rate compared to the etch rate in the same solution without the other additives. This rate is as good as or better than most of the other organic additives mentioned in the literature, and the compound is completely stable in the strongly acidic hydrogen peroxide etching solution.

When tolyltriazole is used in combination with certain organic solvents, surprisingly, a strong synergistic effect is observed. The etch rate increased about twenty times above the rate of a non-accelerated solution with otherwise the same composition and under identical time and temperature conditions. This is about double the etch rate of the fastest processes used in the industry at the present time. This is particularly surprising as tolyltriazole is known to form strongly corrosion resistant monomolecular coatings on copper and copper alloys and, as such, is used in the industry for tarnish protection on these metals. One would thus expect the etch rate to be retarded, rather than enhanced.

Similar results are observed with benzotriazole qualitatively, but the quantitative improvement is significantly less than with tolyltriazole.

The primary etch solution used for the etching experiments, unless otherwise indicated, had the following weight composition:

Sulfuric acid: 15%
Hydrogen peroxide: 10%
Copper (added as a sulphate): 3.8%
Remainder-deionized water
Etch temperature: 43.3° C. (110° F)

The hydrogen peroxide primarily used was the stabilized Hybrite® brand of the FMC Corporation. The stabilizers are phenol, phenolphosphoric acid and organic phosphonates as described in U.S. Patent Nos. 3,649,194 and 4,401,509.

The acid and hydrogen peroxide concentrations and etching temperature used represent a reasonable balance between speed of reaction and economy of operations. Too high a temperature and too high an acid and peroxide concentration will destabilize even a stabilized formula to the point of an excessive hydrogen peroxide consumption. Temperatures above 50° C., although resulting in much faster reactions, become less economical.

The small amount of copper added to the etching solution (as $CuSO_4$) facilitates a faster start-up. Copper acts as a weak accelerator. Normally, it is not necessary to add copper in the beginning because, after a short time, enough copper will be dissolved from the goods to be etched. However, the etch rate will be lower initially. When copper concentration becomes higher no further increase in etch rate is observed after the first 2–4% of dissolved copper. Solution temperatures lower than the 43° C. used will usually slow the reaction, but acceptable rates are obtained at a temperature of 32° C. (90° F).

A series of experiments was performed as shown below. The etching substrate used initially was the UNS-C11000 type of electrolytic soft rolled copper foil (0.010 inch gauge). The amount of additive initially used was 1.25 g tolyltriazole in 50 ml isopropyl alcohol per liter of etchant. Two liter etching baths were used for most of the experiments. The actual etch rate of the first bath was 0.15 mils/min before and 0.65 mils/min after the addition of additive (one mil equals one one-thousandth of one inch).

Next, a new bath was prepared, using the standard acid peroxide and copper concentrations as noted above. The etch rate on a 3 inch×3 inch 10 mil C11000 copper foil coupon was 0.17 mils/min. After adding 2.5 g/1 tolyltriazole in 100 m/1 isopropyl alcohol the rate went immediately to 1.05 mils/min. One hour later the rate went even higher to 1.22 mils/min. After 24 hours the rate was 1.54 mils/min.

In the following experiment, tolyltriazole was added to a newly prepared etching solution of the same basic composition at a concentration of 2.5 g/1 without the alcohol. At 43° C. the etch rate was only 0.75–0.80 mils/min on the copper foil, even after aging of the bath overnight.

Because of the higher etch rate of tolyltriazole predissolved in isopropyl alcohol, the effect of the alcohol as the sole additive was investigated. A 3 to 4 fold increase of etch rate was found when experiments were performed as before. However, the accelerating effect of the tolyltriazole dissolved in isopropyl alcohol is significantly larger than the sum of the rates observed from the tolyltriazole and the isopropyl alcohol, respectively, when used by themselves, indicating a true synergism.

In an extensive test series, a variety of water soluble organic solvents were tested for their effect on etch rates by themselves, and in combination with tolyltriazole. This included aliphatic, olefinic, acetylenic, and aromatic alcohols, esters, ethers, glycolesters and ethers, aldehydes, ketones, nitriles, amides, amines, and acids. Most of these were also effective solvents for tolyltriazoles. The majority of these solvents did increase the etch rate 2 to 4 times when used as the sole additive. However, most of them did not indicate any synergism with tolyltriazole, and in fact, some even decreased the intrinsic effect of tolyltriazole.

Only aliphatic, water-soluble primary, secondary, and tertiary monoalcohols and glycol monoethers are effective synergists, and possibly their peroxy derivatives.

Because isopropanol did decompose by oxidation after a few days in the etching solution, tertiary butylalcohol is preferred. This solvent proved to be much more stable, even though it is slowly oxidized to tertiary butyl hydroperoxide. Tertiary butyl hydroperoxide, instead of the alcohol, was as effective. Other solvents are even more effective as synergists, especially n-butyl alcohol, diethylene glycol monobutylether, and dipropyleneglycol monomethylether.

Two types of printed circuit board stock panels were used as test substrates. The types chosen represent the materials used by most printed circuit manufacturers at the present time. They both comply with the United States Military Specification MIL-P-13949. The types are as follows:

GFN-FR4-C
GFN-FR4-F

They are both plated copper foil on an epoxy-fiberglass board. The "C" type has a smooth surface, untreated; the "F" type is rough with a chromate treatment. Some differences in etching speeds of the three types of substrates were observed. Generally, the soft rolled copper foil etches were fastest, followed by the FR-4-C type. The slowest was the type FR-4-F.

In one experiment, a coupon of aluminum bronze type, UNS C 61300 was compared to the other three substrates. The etching speed on this metal was about equal to one of the FR-4-F type test coupons.

The following examples are provided to further illustrate the invention. For all etching experiments, the 10 mil C11000 copper foil at a size of 3 inches×3 inches, and circuit board coupons at a size of 4 inches×4 inches were used. Both circuit board types were clad on one side with copper with a 2.6 mil thickness.

EXAMPLE 1

Etching bath composition: 15% $H_2SO_4$, 10% $H_2O_2$, Hybrite® brand 15 grams/liter $CuSO_45H_2O$ Temperature: 43.3° C. (110° F)

Increasing amounts of tolyltriazole as the sole accelerator were added for this experimental series. The etch rates are given in Table I.

TABLE I

| Tolyltriazole Concentration grams/liter | Etch Rates for Example 1 C11000 Foil | FR-4-C2/CO PCB Coupon | FR-4-F2/FO PCB Coupon |
|---|---|---|---|
| 0 | 0.19 mils/min | 0.14 mils/min | 0.13 mils/min |
| 0.100 | 0.17 mils/min | — | — |
| 0.250 | 0.07 mils/min | — | — |
| 0.500 | 0.10 mils/min | 0.10 mils/min | 0.10 mils/min |
| 1.25 | 0.61 mils/min | 0.13 mils/min | 0.15 mils/min |
| 2.50 | 0.80 mils/min | 0.54 mils/min | 0.48 mils/min |
| 3.75 | 0.80 mils/min | 0.84 mils/min | 0.82 mils/min |
| 5.00 | 0.83 mils/min | 0.76 mils/min | 0.82 mils/min |
| 10.00 | 0.86 mils/min | 0.70 mils/min | 0.72 mils/min |

Smaller quantities of TTA (tolyltriazole) did decrease the etch rate, but surprisingly, at higher TTA concentrations, the etch rate slowly decreases again. There is an optimum TTA concentration which differs somewhat for each type of metal. The optimum differs when TTA is used together with synergistic solvent. For the C11000 foil, the optimum was 2.5 g/1 TTA; for the FR-4-C type, the optimum was 5 g/1; for the FR-4-F type, the optimum was 7.5 g/1.

EXAMPLE 2

Two liter etching baths were prepared with the same basic composition as for Example 1 and heated to 110° F. Without any accelerator, the etching rate on the C11000 coupon was 0.16 mils/min. To bath "A" 5 grams of TTA in 100 ml isopropanol were added. To bath "B" 5 grams of TTA in 100 ml tertiary butanol were added. The etch results on C11000 coupons were as follows:

A:
1.85 mils/min 70 minutes after accelerator addition.
2.42 mils/min 4 hours after accelerator addition.
0.55 mils/min 24 hours after accelerator addition.

B:
1.98 mils/min 60 minutes after accelerator addition.
1.99 mils/min 22 hours after accelerator addition.
2.25 mils/min 42 hours after accelerator addition.

EXAMPLE 3

Two 2-liter etching baths were prepared as in the previous Example and heated 110° F. Before accelerator addition, the etch rates were 0.14 mils/min for a FR-4-C2/CO coupon and 0.13 mils/min for a FR-4-F2/FO coupon. To bath "A" 10 grams of TTA in 100 ml tertiary butanol were added and to bath "B" 15 grams of TTA in 100 ml tertiary butanol were added. The etch results follow:

A:
1.76 mils/min for the C2/CO coupon.
0.99 mils/min for the F2/FO coupon.

B:
1.10 mils/min for the C2/CO coupon.
1. 51 mils/min for the F2/FO coupon.

EXAMPLE 4

For comparison, another two liter bath was prepared, as in Examples 2 and 3, and accelerated with 200 parts per million of silver (from silver sulfate) as recommended in U.S. Patent No. 3,407,141. The results follow:

1.10 mils/min C11000 coupon.
0.72 mils/min FR-4-C2/CO coupon.

EXAMPLE 5

A two liter bath prepared with 15 grams of TTA in 100 ml tertiary butanol, as in Example 3, was left standing at room temperature for 170 hours. The decrease of hydrogen peroxide concentration over this time period was only 4.8% of the peroxide content, i.e., 0.028% per hour.

EXAMPLE 6

A two liter bath was prepared, as in Example 1, as additive, 10 grams TTA in 100 ml n-butanol was used. The temperature was 110° F. The bath was replenished with sulfuric acid and hydrogen peroxide prior to the second and third etchings. The bath was heated only prior to etching, otherwise, it was kept at room temperature.

The etch rates on FR-4-C2/CO coupons were as follows:

2.40 mils/min after 2 hours.
2.30 mils/min after 28 hours.
2.57 mils/min after 18 days.

EXAMPLE 7

Two 8 gallon batches of etching solutions were prepared. Each consisted of 15% sulfuric acid, 10% Hybrite® brand hydrogen peroxide, 15 g/1 $CuSO_4.5H_2O$ and 5 gram tolyltriazole in 50 ml n-butanol, per liter of etching solution. Solution "A" was made up with hydrogen peroxide as was used for all the experiments mentioned so far. Solution "B" was made up with a hydrogen peroxide that contained the same stabilizers, but at only 70% of the amount of the stabilizer in the first hydrogen peroxide. The two batches were tested at the premise of a printed circuit manufacturing company at a temperature of 110° F. The results: etching substrate: FR-4-C2/CO coupons:

Solution A: 2.6–2.8 mils/min
Solution B: 2.8–3.7 mils/min

EXAMPLE 8

Two 2-liter baths were prepared, similar to Example 1.

Accelerator for Solution A:
10 g tolyltriazole in 100 m butylcarbitol (diethyleneglycol monobutyl ether)

Accelerator for Solution B:
10 g tolyltriazole in 100 ml dipropyleneglycol monomethyl ether.

The etch rates at 110° F on FR-4-C2/CO coupons were:
A: 2.37 mils/min
B: 2.25 mils/min

EXAMPLE 9

This example uses nitric acid instead of sulfuric acid.

Bath Concentrations: 15% of $HNO_3$, 10% $H_2O_2$ 15 g/1 $CuSo_4.5H_2O$.

Etch rate of FR4-F2/FO coupons: 0.30 mils/min at 110° F (no accelerator).

With 7.5 g/1 tolyltriazole in 50 ml/l dipropyleneglycol monoethyl ether, the following etch rates were observed:

0.78 mils/min at 110° F
0.96 mils/min at 120° F
1.02 mils/min at 130° F

Similar results were obtainable with the weaker acid, phosphoric acid. Higher temperatures with higher acid and peroxide concentrations are necessary to provide sufficient etch rates for many applications. However, the improvement with the triazoles and the monoalcohol and/or glycol monoether are similar to those observed with the stronger acids (Sulphuric and Nitric).

EXAMPLES 10–37

The following eleven solutions and 27 experiments were performed.

Solutions:

Bath size for all experiments: 2 liters, Etching subtrate: FR-4 F2/FO coupons. $H_2O_2$ type used: Hybrite 50%, etching grade. Etching was done at various temperatures.

1. Solution made with 15% $H_2SO_4$, 10% $H_2O_2$, 30 g $CuSO_4.5H_2O$.
2. Same solution as #1-plus 15g of benzotriazole in 100ml butylcarbitol.
3 Solution made with 15% $H_2SO_4$, 17% $H_2O_2$, 30g $CuSO_4.5H_2O$.
4. Same solution as #3-plus 15g of benzotriazole in 100ml butylcarbitol.
5. Solution made with 30% $H_3PO_4$ 10% $H_2O_2$, 30g $CuSO_4$. $5H_2O$.
6. Same solution as #5-plus 15g tolyltriazole in 100ml butylcarbitol.
7. Solution made with 35% $H_3PO_4$, 17% $H_2O_2$, 30g $CuSO_4.5H_2O$.
8. Same solution as #7-plus 15g tolyltriazole in 100ml butylcarbitol.
9. Solution made with 35% sulfamic acid added which was not soluble. 20–25% sulfamic acid in solution, 17% $H_2O_2$, 30 g $CuSO_4.5H_2O$.
10. Solution made with 15% sulfamic acid, 10% $H_2O_2$,, 30g $CuSO_4.5H_2O$.
11. Same solution as no. 10 plus 15g tolyltriazole in 100ml butylcarbitol.

Results Etch Rate:

EXAMPLES:

10 0.37 mils/min. at 110° F. (Solution 1).
11. 0.37 mils/min. at 78° F. (Solution 2).
12. 0.58 mils/min. at 90° F. (Solution 2).
13. 0.77 mils/min. at 100° F. (Solution 2).
14. 0.96 mils/min. at 110° F. (Solution 2).
15. 0.51 mils/min. at 110° F. (Solution 3).
16. 0.72 mils/min. at 70° F. (Solution 4).
17. 1.27 mils/min at 90° F. (Solution 4).
18. 2.18 mils/min. at 100° F. (Solution 4).
19. >5.1 mils/min. at 110° F. (Solution 4).
20. 0.14 mils/min. at 110° F. (Solution 5).
21. 0.21 mils/min. at 120° F. (Solution 5).
22. 0.44 mils/min. at 130° F. (Solution 5).
23. 0.64 mils/min. at 140° F. (Solution 5).
24. 0.30 mils/min. at 110° F. (Solution 6).
25. 0.43 mils/min. at 120° F. (Solution 6).
26. 0.56 mils/min. at 130° F. (Solution 6).
27. 0.77 mils/min. at 140° F. (Solution 6).
28. 0.50 mils/min. at 120° F. (Solution 7).
29. 0.89 mils/min. at 140° F. (Solution 7).
30. 0.81 mils/min. at 160° F. (Solution 7).
31. 0.49 mils/min. at 110° F. (Solution 8).
32. 0.56 mils/min. at 120° F. (Solution 8).
33. 0.96 mils/min. at 130° F. (Solution 8).
34. 1.33 mils/min. at 140° F. (Solution 8).
35. 1.15 mils/min at 110° F. (mirror bright finish) Solution 9.
36. 0.51 mils/min. at 110° F. (mirror bright finish), Solution10.
37. 0.18 mils/min. at 110° F. (greenish-grey powdery deposit), Solution 11.

I claim:

1. In a method for etching copper which includes treating the copper with an aqueous etchant solution, said solution including a mixture of an acid selected from the group consisting of sulfuric acid, nitric acid, sulfamic acid, and phosphoric acid; hydrogen peroxide; and water; the improvement which comprises incorporating an accelerating effective amount of both tolyltriazole and either an aliphatic water soluble monoalcohol or a glycol monoether in the etchant solution to provide a faster etching rate.

2. The method of claim 1 wherein the triazole compound is incorporated in the solution at concentration of 1.5 gram/liter to 15 gram/liter of solution.

3. The method of claim 2 wherein the sulfuric acid weight concentration is within the range of 5% to 25% of the solution and the hydrogen peroxide weight concentration is within the range of 5% to 25% of the solution.

4. The method of claim 2 wherein the solution includes hydrated copper sulfate at a concentration of 1% to 10% by weight.

5. The method of claim 2 wherein the solution is maintained at a temperature within the range of 25? C. to 50? C.

6. The method of claim 1 wherein the hydrogen peroxide is stabilized with a compound selected from the group consisting of a phenol, a phenol phosphoric acid, and a phosphonate.

7. The method of claim 1, 2, 3, 4, or 5 wherein the monoalcohol is selected from the group consisting of isopropanol, n-butyl alcohol, and t-butyl alcohol and the glycol monoether is selected from the group consisting of diethylene glycol monobutyl ether, and dipropylene glycol monoethyl ether.

8. The method of claim 7 wherein the triazole compound is mixed with the monoalcohol or the glycol monoether prior to incorporation in the solution.

9. The method of claim 8 wherein the solution includes hydrated copper sulfate at a concentration of 1% to 10% by weight.

10. In a method for etching copper which includes treating the copper with an aqueous etchant solution, said solution including a mixture of an acid selected from the group consisting of sulfuric acid, nitric acid, sulfamic acid, and phosphoric acid; hydrogen peroxide; and water; the improvement which comprises incorporating an accelerating effective amount of tolyltriazole in the etchant solution to provide a faster etching rate.

11. The method of claim 10 wherein the triazole compound is incorporated in the solution at a concentration of 1.5 gram/liter to 15 gram/liter of solution.

12. The method of claim 10 wherein the hydrogen peroxide is stabilized with a compound selected from the group consisting of a phenol, a phenol phosphoric acid, and a phosphonate.

13. The method of claim 10 wherein the sulfuric acid weight concentration is within the range of 5% to 25% of the solution and the hydrogen peroxide weight concentration is within the range of 5% to 25% of the solution.

14. The method of claim 10 wherein the solution includes hydrated copper sulfate at a concentration of 1% to 10% by weight.

15. The method of claim 10 wherein the solution is maintained at a temperature within the range of 25° C. to 50° C.

16. In an etchant solution composition which is useful for etching copper containing surfaces which includes a mixture of an acid selected from the group consisting of sulfuric acid, nitric acid, sulfamic acid, and phosphoric acid; hydrogen peroxide; and water; the improvement which comprises incorporating an accelerating effective amount of both tolyltriazole and either an aliphatic water soluble monoalcohol or a glycol monoether in the ethcant solution to provide a faster etching rate.

17. The composition of claim 16 wherein the triazole compound is incorporated in the solution at a concentration of 1.5 gram/liter to 15 gram/liter of solution.

18. The composition of claim 17 wherein the sulfuric acid weight concentration is within the range of 5% to 25% of the solution and the hydrogen peroxide weight concentration is within the range of 5% to 25% of the solution.

19. The composition of claim 17 wherein the solution includes hydrated copper sulfate at a concentration of 1% to 10% by weight.

20. The composition of claim 16 wherein the hydrogen peroxide is stabilized with a compound selected from the group consisting of a phenol, a phenol phosphoric acid, and a phosphonate.

21. The composition of claim 16, 17, 20, 18 or 19 wherein the monoalcohol is selected from the group consisting of isopropanol, n-butyl alcohol, and t-butyl alcohol and the glycol monoether is selected from the group consisting of diethylene glycol monobutyl ether, and dipropylene glycol monoethyl ether.

22. In an etchant solution composition which is useful for etching copper containing surfaces which includes a mixture of an acid selected from the group consisting of sulfuric acid, nitric acid, sulfamic acid, and phosphoric acid; hydrogen peroxide; and water; the improvement which comprises incorporating an accelerating effective amount of tolyltriazole in the etchant solution to provide a faster etching rate.

23. The composition of claim 22 wherein the triazole compound is incorporated in the solution at a concentration of 1.5 gram/liter to 15 gram/liter of solution.

24. The composition of claim 22 wherein the hydrogen peroxide is stabilized with a compound selected from the group consisting of a phenol, a phenol phosphoric acid, and a phosphonate.

25. The composition of claim 22 wherein the sulfuric acid weight concentration is within the range of 5% to 25% of the solution and the hydrogen peroxide weight concentration is within the range of 5% to 25% of the solution.

26. The composition of claim 22 wherein the solution includes hydrated copper sulfate at a concentration of 1% to 10% by weight.

27. The composition of claim 22 which additionally contains either an aliphatic monaolcohol or glycol monoether.

* * * * *